United States Patent [19]

Nilssen

[11] Patent Number: 4,970,438

[45] Date of Patent: Nov. 13, 1990

[54] ELECTRONIC FLUORESCENT LAMP BALLASTING SYSTEM

[76] Inventor: Ole K. Nilssen, Caesar Dr., Barrington, Ill. 60010

[21] Appl. No.: 418,741

[22] Filed: Oct. 2, 1989

Related U.S. Application Data

[63] Continuation of Ser. No. 738,269, May 28, 1985, abandoned.

[51] Int. Cl.[5] ..... H05B 37/02

[52] U.S. Cl. ..... 315/225; 315/256; 315/DIG. 5; 315/DIG. 7

[58] Field of Search ..... 315/209 R, 224, 256, 315/225, DIG. 7, DIG. 5; 331/113 A; 338/20; 363/50, 159, 172

[56] References Cited

U.S. PATENT DOCUMENTS

| | | | |
|---|---|---|---|
| 3,727,104 | 4/1973 | Neal et al. | 315/91 |
| 4,293,799 | 10/1981 | Roberts | 315/256 |
| 4,438,372 | 3/1984 | Zuchtriegel | 315/224 |

*Primary Examiner*—Robert J. Pascal

[57] ABSTRACT

A lighting arrangement comprises;

(i) a plurality of pairs of mutually parallel-oriented fluorescent lamps, each pair of lamps adapted to be powered from 30 kHz/240 Volt by way of a high-Q series-resonant L-C ballasting circuit;

(ii) a relatively low-power frequency converter connected with the power line and operable to provide power for heating the cathodes in these fluorescent lamps, thereby conditioning the lamps for easy starting;

(iii) a relatively high-power frequency converter also connected with a power line and operable to provide the 30 kHz/240 Volt required for operating the plurality of pairs of fluorescent lamps by way of the high-Q series-resonant L-C ballasting circuit; and (iv) delay means operable to prevent the 30 kHz/240 Volt provided by the high-power frequence converter from being applied to the fluorescent lamps until after power has been applied to heat the lamp cathodes for at least one second.

Each high-Q series-resonant L-C ballast circuit is protected from over-voltages by a Varistor, which acts as a substitute load in case a lamp is removed or fails to operate properly. If current should flow through the Varistor for more than about 100 milli-seconds, however, a protection circuit operates to place a short circuit across the Varistor, thereby preventing excessive long term poower dissipation and/or damage to the Varistor.

19 Claims, 3 Drawing Sheets

ELECTRONIC FLUORESCENT LAMP BALLASTING SYSTEM

This application is a continuation of application Ser. No. 06/738,269 filed 05/28/85 and now abandoned.

BACKGROUND OF THE INVENTION

1. Field of Invention

The present invention relates to a system for ballasting an array of mutually parallel-oriented fluorescent lamps.

2. Prior Art

Presently when ballasting a plurality of fluorescent lamps, such as in a sun tanning bed that typically comprises between 20 and 40 fluorescent lamps, with each lamp being 72' long and requiring about 100 Watt of power input for effective operation, these lamps are powered by way of a plurality of individual power-line-operated ballasts, with each ballast powering one or two lamps.

The fluorescent lamps most often used in these applications are of the so-called rapid-start type; which implies that each lamp requires four separate supply wires for proper operation. As a result, the number of wires required for powering 20-to-40 fluorescent lamps gets to be very high.

SUMMARY OF THE INVENTION

Brief Description

In its preferred embodiment, subject invention constitutes a ballasting system for an array of several series-connected pairs of mutually parallel-oriented fluorescent lamps. Each lamp has a first pair and a second pair of cathode terminals; and the lamps are positioned such that all the first pairs of cathode terminals are aligned along a first straight line, and all the second pairs of cathode terminals are aligned along a second straight line. The ballasting system is adapted to be powered from an ordinary electric utility power line and comprises:

(a) a relatively low-power first frequency converter means connected with the power line and controllably operable to provide a first AC voltage for heating the cathodes of all the fluorescent lamps, thereby conditioning them for easy starting;

(b) a relatively high-power second frequency converter means connected with the power line and controllably operable to provide a second AC voltage (30kHz/240Volt) for providing operating power to all the pairs of fluorescent lamps;

(c) a first cathode transformer connected with said AC voltage and operable to provide cathode heating power to said first pairs of cathode terminals, this first transformer being located near said first pairs of cathode terminals;

(d) a second cathode transformer connected with said first output and operable to provide cathode heating power to said second pairs of cathode terminals, this second transformer being located near said second pairs of cathode terminals;

(e) for each pair of fluorescent lamps, a high-Q series-resonant L-C ballast circuit operable to power the pair of lamps from the second AC voltage, with each of the L-C ballast circuits: i) being connected with this second AC voltage, (ii) having voltage-limiting means and circuit-protection means operative to prevent over-voltage and excessive power dissipation in case a lamp is inoperative or disconnected, and iii) being located near said first pairs of cathode terminals; and (f) delay means operable to prevent the second AC voltage from being applied to the L-C ballast circuits until after the first AC voltage has had an opportunity to heat the lamp cathodes to incandescence.

FIGS. *2a* and *2b* diagramatically describes the preferred embodiment of the overall ballasting system.

Figure 3:
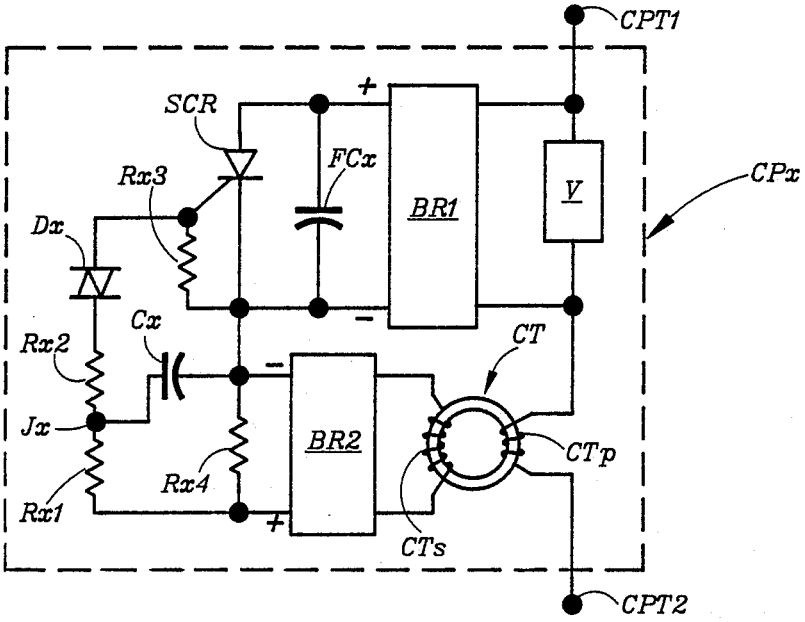

FIG. 3 provides schematic details of the voltage-limiting and circuit-protection means.

DESCRIPTION OF THE PREFERRED EMBODIMENT

Details of Construction

Figure 1:
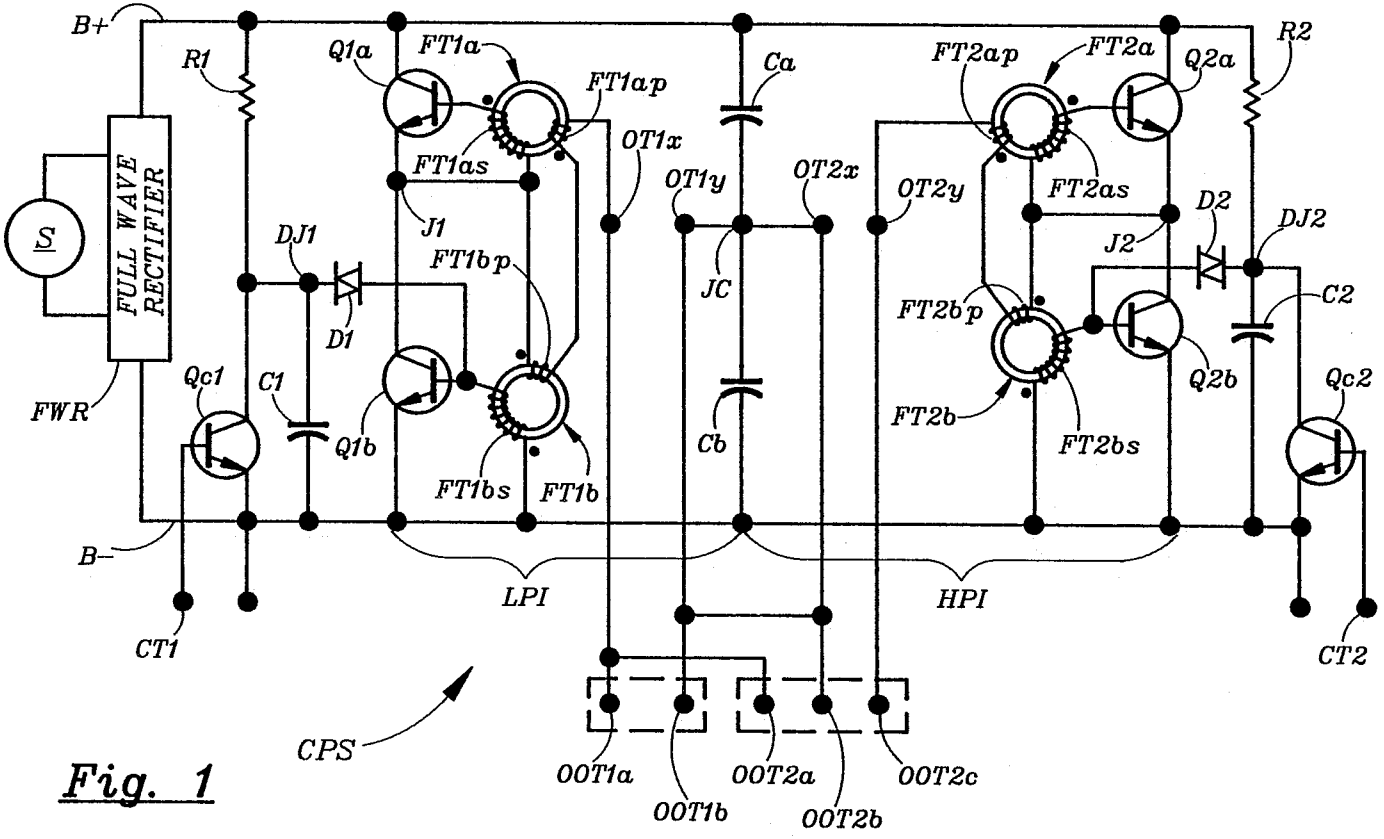
FIG. 1 provides a schematic illustration of the central frequency-converting power supply.

FIG. 1 shows an AC voltage source S, which is a 240Volt/60Hz electric utility power line.

Connected to S is a full-wave rectifier FWR that rectifies the AC voltage from S to provide an unfiltered DC voltage between a positive power bus B+ and a negative power bus B−.

A first pair of transistors Qla and Qlb are connected in series between the B+ bus and the B− bus in such a way that the collector of Q1*a* is connected to the B+ bus, the emitter of Q1*a* is connected with the collector of Q1*b* at a junction J1, and the emitter of Q1*b* is connected with the B− bus.

A second pair of transistors Q2a and Q2b are connected in series between the B+bus and the B- bus in such a way that the collector of Q2*a* is connected to the B+ bus, the emitter of Q2*a* is connected with the collector of Q2b at a junction J2, and the emitter of Q2*b* is connected with the B− bus.

Primary winding FTlap of saturable feedback transformer FTla and primary winding FTlbp of saturable feedback transformer FTlb are connected in series between junction Jl and inverter output terminal OTlx. The other inverter output terminal OTly is connected with junction JC between capacitors Ca and Cb; which capacitors are connected in series between the B+bus and the B− bus.

Primary winding FT2ap of saturable feedback transformer FT2a and primary winding FT2bp of saturable feedback transformer FT2b are connected in series between junction J2 and inverter output terminal OT2y. The other inverter output terminal OT2x is also connected with junction JC.

Secondary winding FTlas of feedback transformer FTla is connected between the base and the emitter of transistor Qla; and secondary winding FTlbs of feedback transformer FTlb is connected between the base and the emitter of transistor Qlb.

Secondary winding FT2as of feedback transformer FT2a is connected between the base and the emitter of transistor Q2a; and secondary winding FT2bs of feedback transformer FT2b is connected between the base and the emitter of transistor Q2b.

A resistor R1 is connected between the B+bus and a junction DJl; and a capacitor Cl is connected between junction DJl and the B− bus. A Diac Dl is connected between junction DJl and the base of transistor Qlb. A control transistor Qcl is connected with its collector to junction DJl and with its emitter to the B−bus. Its base is connected with a control terminal CT1.

A resistor R2 is connected between the B+bus and a junction DJ2. A capacitor C2 is connected between junction DJ2 and the B− bus. A Diac D2 is connected between junction DJ2 and the base of transistor Q2b. A control transistor Qc2 is connected with its collector to junction DJ2 and with its emitter to the B−bus. Its base is connected with a control terminal CT2.

The assembly consisting of transistors Qla and Qlb, feedback transformers FTla and FTlb, and output terminals OTlx and OTly is referred to as low power inverter LPI. The output from this low power inverter LPI is provided between overall output terminals OOTla and OOTlb, as well as between overall output terminals OOT2a and OOT2b.

The assembly consisting of transistors Q2a and Q2b, feedback transformers FT2a and FT2b, and output terminals OT2x and OT2y is referred to as high power inverter HPI. The output from this high power inverter HPI is provided between overall output terminals OOT2b and OOT2c.

The overall power supply of FIG. 1 is referred to as central power supply CPS.

Figure 2A:
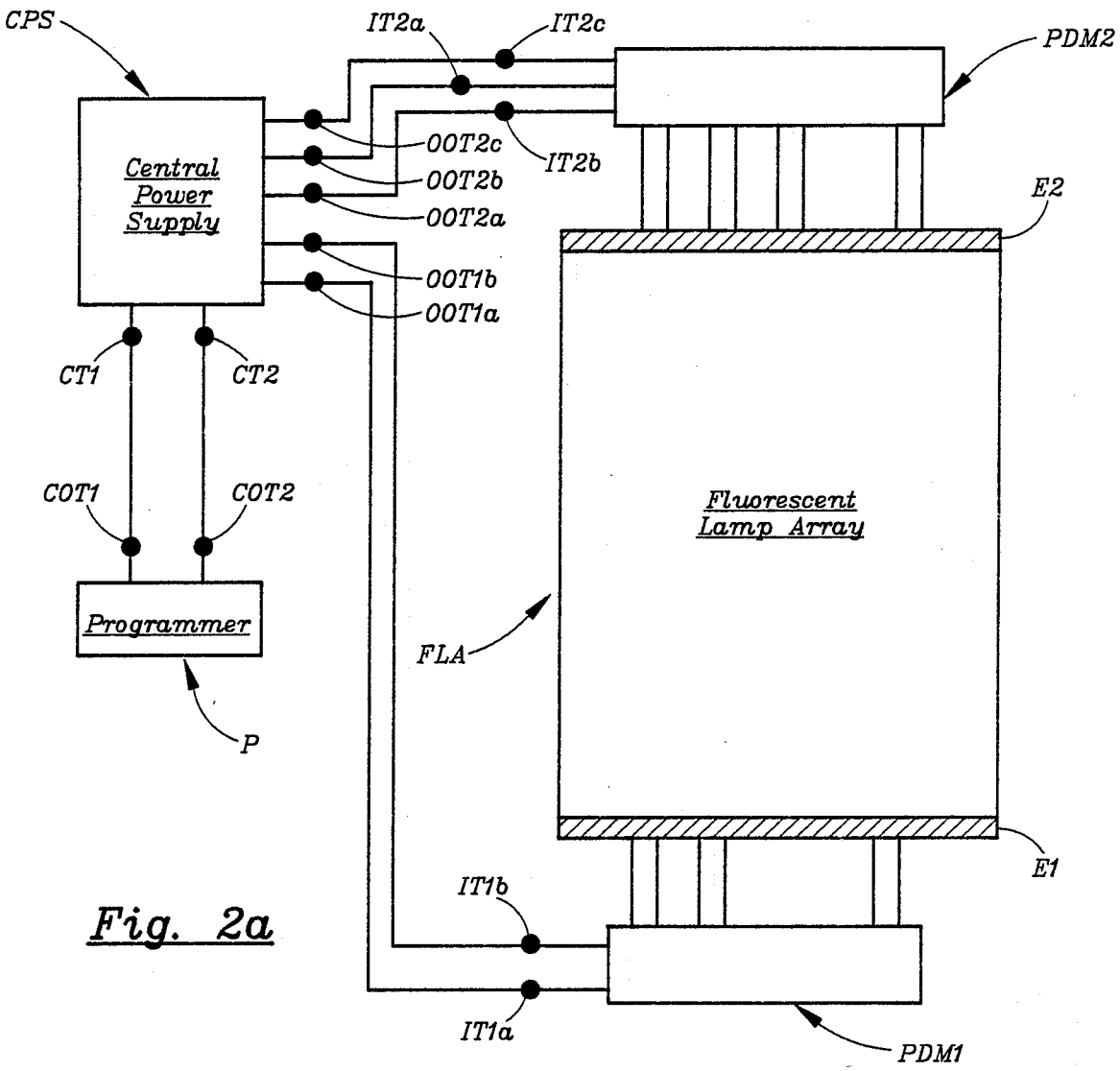
Figure 2B:
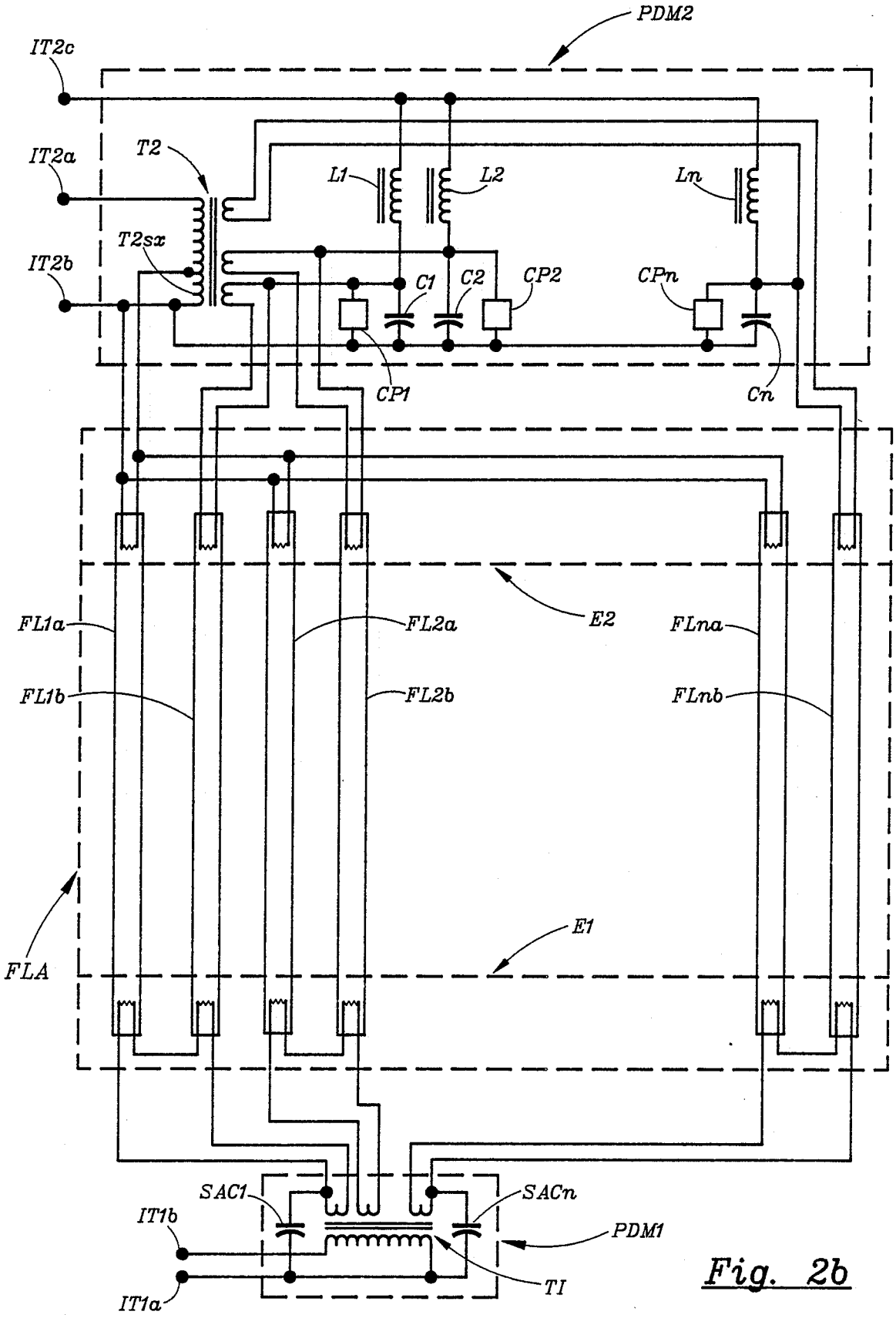

FIGS. 2*a* and 2*b* illustrate the preferred overall system for operating an array FLA of a plurality of fluorescent lamps.

With reference to FIG. 2*a*, overall output terminals OOTla and OOTlb of central power supply CPS are connected respectively with input terminals ITla and ITlb of a power distribution means PDMl; which power distribution means is mounted next to one end El of fluorescent lamp array FLA. Overall output terminals OOT2a, OOT2b and OOT2c of central power supply CPS are connected respectively with input terminals IT2a, IT2b and IT2c of a power distributing means PDM2; which power distributing means is mounted adjacent the other end E2 of fluorescent lamp array FLA.

Still with reference to FIG. 2*a*, control terminals CTl and CT2 of central power supply CPS are respectively connected with control output terminals COTl and COT2 of programmer P.

With reference to FIG. 2*b*, fluorescent lamp array FLA comprises a plurality of pairs of fluorescent lamps: FLla/FLlb, FL2a/FL2b ---- FLna/FLnb.

Power distribution means PDM2 comprises a corresponding plurality of L-C ballasting means: Ll/Cl, L2/C2 ---- Ln/Cn; all of which are connected between input terminals IT2b and IT2c. Lamp pairs FLla/FLlb, FL2a/FL2b ---- FLna/FLnb, by way of their upper cathodes (i.e., those cathodes located at or near end E2 of fluorescent lamp array FLA), are respectively connected across capacitors Cl, C2 ---- Cn. Also connected across capacitors Cl, C2 ---- Cn are circuit protectors CPl, CP2 ---- CPn, respectively.

Power distribution means PDM2 additionally comprises a transformer T2, which has its primary winding connected between input terminals IT2a and IT2b. This transformer has one special secondary winding T2sx, the output of which is connected with the parallel combination of all the upper cathodes of fluorescent lamps FLla, FL2a ---- FLna. Transformer T2 also has a plurality of ordinary secondary windings, one connected with each of the upper cathodes of fluorescent lamps FLlb, FL2b ---- FLnb.

Power distribution means PDMl comprises a transformer Tl, which has its primary winding connected between input terminals ITla and ITlb. This transformer has a plurality of secondary windings, with one such secondary winding being connected with the series-connection of the lower cathodes (i.e., the cathodes located at or near end El of fluorescent lamp array FLA) of each fluorescent lamp pair FLla/FLlb, FL2a/FL2b ---- FLna/FLnb. Starting aid capacitors SACl and SACn are connected from input terminal ITla to the lower cathodes of lamps FLla and FLnb, respectively. A starting aid capacitor is similarly connected with the lower cathode of lamp FL2a as well, but is not shown.

FIG. 3 provides details of a circuit protector CPx; which circuit protector is like those identified in FIG. 2*b* as CP1, CP2 ---- CPn. This circuit protector has two terminals CPT1 and CPT2. Connected in series across these two terminals is a Varistor V and the primary winding CTp of a current transformer CT. Connected in parallel with Varistor V is a first bridge rectifier BRl, across the output of which is connected a filter capacitor FCx and a thyristor SCR -- the anode of the SCR being connected with the positive terminal of the output of BRl, the cathode being connected with the negative terminal. Across the secondary winding CTs of current transformer CT is connected a second bridge rectifier BR2, the negative output terminal of which is connected with the negative output terminal of BRl. The positive output terminal of BR2 is connected through a resistor Rxl to a junction Jx. An energy-storing capacitor Cx is connected between junction Jx and the negative terminal of BR2. A series-combination of a Diac Dx and a resistor Rx2 is connected between junction Jx and the gate of thyristor SCR. A resistor Rx3 is connected between the gate and the cathode of thyristor SCR; and a resistor Rx4 is connected directly across the output of BR2.

Details of Operation

The operation of the central power supply CPS of FIG. 1 may be explained as follows.

FIG. 1 shows two half-bridge inverters: a low power inverter LPI consisting of transistors Qla and Qlb with their respective saturable positive feedback transformers FTla and FTlb; and a high power inverter HPI consisting of transistors Q2a and Q2b with their respective saturable positive feedback transformers FT2a and FT2b.

Both inverters are capable of self-oscillation by way of positive feedback. When they do oscillate, the frequency of oscillation is about 30 kHz. For further explanation of the operation of this type of inverter, reference is made to U.S. Pat. Nos. 4,184,128 and 4,506,318, both issued to Nilssen.

Each of these inverters has to be triggered into oscillation; but they will only oscillate as long as the magnitude of the voltage between the B− bus and the B+ bus exceeds about 20 Volt. Thus, if one of the inverters is triggered into oscillation at the beginning of one of the sinusoidally-shaped DC voltage pulses existing between the B− bus and the B+bus (as resulting from the unfiltered full-wave rectification of the voltage from the 240Volt/60Hz power line), that inverter will cease oscillating at the end of that DC voltage pulse.

Thus, to keep either one of the inverters operating on a continuous basis, it is necessary that it be re-triggered 120 times per second: once in the beginning of each half-cycle of the full-wave-rectified 240Volt/60Hz power line voltage.

Both the half-bridge inverters use capacitors Ca and Cb to provide for an effective center-tap between the B− bus and the B+ bus—this center-tap being junction JC.

In normal operation, both inverters will provide a relatively high-frequency (30 kHz) squarewave AC voltage 100% amplitude-modulated at a frequency of 120 Hz.

Absent any control signals at control terminals CTl and CT2, when power line voltage is applied to the arrangement of FIG. 1, inverters LPI and HPI will both commence operation, receiving the requisite trigger pulses by way of trigger assemblies Rl/Cl/Dl and R2/C2/D2, respectively. The time-constants associated with Rl/Cl and R2/C2 are such as to cause the voltages on Cl and C2 to reach levels high enough for Diacs D1 and D2 to break down within about one milli-second after the beginning of each sinusoidally-shaped DC pulse provided by the full wave rectifier.

As a result of the relatively short time-constants, repeated triggering will occur during each complete DC pulse. While most often such repeated triggering is of little consequence, it is sometimes desirable to avoid it altogether; which may be accomplished by adding a first diode between junction DJl and the collector of transistor Qlb and a second diode between junction DJ2 and the collector of transistor Q2b—in both cases with the anodes of the diodes being connected with the junctions.

On the other hand, with a positive control signal provided to each of control terminals CTl and CT2, inverters LPI and HPI are both prevented from being triggered and thereby prevented from entering operation. Thus, by providing and/or removing such control signals from control terminals CTl and/or CT2, either inverter can be selectively switched between operation and non-operation—in complete independence of the other inverter.

With reference to FIG. 2*a*, programmer P—which is of conventional design—provides programmed positive control signals to the two control terminals, thereby providing for such selective and individual control of the operation of the two inverters—causing them to operate or non-operate, selectively and individually, in accordance with any desired program. In the preferred embodiment, starting from a situation where both inverters were non-operating on account of being both provided with a positive control signal, the desired program provides for a sequence of signals and results as follows.

(i) Initially, the positive control signal provided to CTl is removed, thereby causing inverter LPI to..initiate operation. As a result, cathode heating power is provided to all the cathodes of the fluorescent lamp array.

(ii) About 1.5 seconds later, the positive control signal provided to CT2 is removed, thereby, causing inverter HPI to initiate operation. As a result, the 30 kHzoutput voltage from the HPI inverter is now applied to all the L-C ballasting circuits, thereby—since the cathodes by now have become completely incandescent—easily starting the fluorescent lamps.

(iii) After the lamps have started, which—with preheated cathodes—is apt to take only a few milliseconds, the positive control signal is re-applied to control the terminal CT1, thereby stopping inverter LPI from operation; which, in turn, reduces the overall power required for operating the fluorescent lamps.

(iv) After a more extended period, which in a sun tanning application might typically be 30 minutes, the positive control signal is re-applied to control terminal CT2, thereby stopping inverter HPI from operation and turning off the light from the fluorescent lamps.

With reference to FIG. 2*b*, it is indeed seen that the first 30 kHz voltage provided from the output of inverter LPI is applied, by way of transformers Tl and T2, to the cathodes of the fluorescent lamps in the array FLA. And, it is also seen that the second 30 kHz voltage from inverter HPI is applied across all the series-connected L-C circuits, such as the constituted by Ll/Cl; which L-C circuits are resonant at or near the frequency of the applied 30 kHz voltage.

In each of these L-C circuits, both the capacitor and the inductor have. relatively high Q-factors; which implies that there will be a substantial Q-multiplication effect. That is, absent any loading, the magnitude of the voltage developing across the capacitor will be larger by a factor of Q in comparison to the magnitude of the voltage applied to the series-resonant L-C circuit. Since the net unloaded Q-factor of the L-C circuit in the preferred embodiment is over 100, the magnitude of the voltage developing across the capacitor—assuming linear operation and no break-down -- would reach 12,000 Volt with an input of 120 Volt.

However, each L-C circuit is loaded both by two series-connected fluorescent lamps and a circuit protector; which circuit protector acts to limit the maximum voltage that can develop across the capacitor to a level that is appropriate for proper lamp starting.

With additional reference to FIG. 3, it is seen that the Varistor is in effect connected in parallel with the capacitor of the L-C circuit, and thereby in parallel with the two associated series-connected lamps. The voltage drop across the primary winding of current transformer CT is so small as to be negligible in comparison with the voltage present across the Varistor when it is performing voltage-clamping.

The clamping voltage of the Varistor is so chosen that—in the absence of the fluorescent lamps—the magnitude of the voltage developing across the capacitor is just right for proper rapid-starting of the two series-connected lamps.

With the Varistor chosen so as to clamp the voltage across the capacitor to a magnitude just right for rapid-starting of the two series-connected lamps, substantially no current will flow through the Varistor after the lamps have started. Moreover, the lamps will not start if the cathodes are non-incandescent.

When the lamps' cathodes are fully incandescent, the lamps will rapid-start in a matter of a few milli-seconds. However, due to the voltage-magnitude-limiting provided by the Varistor, with cold cathodes the lamps won't start at all.

If for some reason the lamps should not start—perhaps because they were damaged, worn out, or otherwise inoperative, or perhaps because they were disconnected—Varistor V will conduct; and current will then flow through primary winding CTp of current transformer CT. As a result, a 30 kHz voltage is developed across resistor Rx4; which voltage is rectified by bridge-rectifier BR2 and applied by way of resistor Rxl to capacitor Cx. The time-constant associated with charging capacitor Cx is so chosen that, after about 100 milli-seconds, the voltage on capacitor Cx reaches a magnitude high enough to cause Diac Dx to break down; which then results in a current being applied to the gate of thyristor SCR.

With current applied to its gate, thyristor SCR will trigger into its conductive state; which implies that it will cause an effective short circuit to be applied across the Varistor. This short circuit will continue to provide current for the primary winding of current transformer CT; which will therefore cause the short circuit to perpetuate itself in positive feedback fashion.

Thus, if a given pair of fluorescent lamps do not start within about 100 milli-seconds after having been provided with operating voltage, a short circuit will be applied across the lamps, thereby preventing excess power drain from inverter HPI as well as damage to the Varistor.

With the capacitor effectively shorted, the associated inductor will be subjected to the full voltage from inverter HPI. However, this will only give rise to a modest amount of inductively reactive load current and will case no significant ill effect.

Additional Comments (a) During the few milli-seconds after power has been applied from inverter HPI, but before the lamps have started, the L-C series-resonant ballasting circuits are each loaded with a Varistor, thereby preventing destructive over-voltages. During this brief period, the Varistor absorbs power at a rate of nearly twice that of the two associated lamps when they are operating. That is, during these initial few milli-seconds, each Varistor absorbs power at a rate of about 400 Watt in the typical situation where each lamp draws about 100 Watt during normal operation.

However, the Varistor—although it can absorb a very large amount of power for a brief period of time—can only absorb a miniscule) amount of power on an average basis: a large-capacity Varistor is typically rated at about 1 Watt average power, although it may have a rating of perhaps 80 Joule in terms of energy-absorbing capacity. Thus, in subject system, a Varistor will indeed be able for 100 milli-second or so to safely absorb the approximately 400 Watt or power dissipation it is subjected to in case a pair of lamps fails to start—thereby absorbing a total amount of energy of about 40 Joule. However, it would not be able to absorb that level of power for longer than about 200 milli-seconds.

(b) Due to the resonant nature of the ballasting circuit, the current flowing into each lamp-ballast combination will be substantially sinusoidal in waveshape even though the driving voltage is a squarewave.

(c) The fundamental nature of a high-Q resonant series-excited L-C circuit that is parallel-loaded with a gas discharge lamp, is one of providing this lamp with current from the near-equivalent of an ideal current source, with the magnitude of the current provided to the lamp being roughly proportional to the magnitude of the driving voltage, As an overall result, the RMS magnitude of the current drawn from central power supply CPS by the plurality of lamp-ballast assemblies will be roughly proportional to the RMS magnitude of the squarewave voltage provided by this central power supply; which, since this squarewave voltage-is amplitude-modulated in direct proportion to the instantaneous magnitude of the DC voltage provided from the full wave rectifier, implies that the magnitude of the instantaneous current drawn by the central power supply from the power line will be roughly proportional to the instantaneous magnitude of the voltage provided therefrom. Thus, the power factor by which the central power supply draws power from the power line will be high—approaching 100%.

(d) The amount of power that has to be provided by the low-power inverter LPI is less than 10% of the amount of power that has to be provided by high-power inverter HPI.

(e) The fluorescent lamps are started in a particularly gentle rapid-start fashion: the cathodes are allowed to reach full incandescence before lamp operating voltage is applied; and lamp starting aid is provided both by way of a starting capacitor (ex: CAPl in FIG. 2*b*) and by way of providing a ground-plane next to each lamp. (The ground-plane is not shown, but is present in the form of a grounded reflector mounted behind the lamps.)

(f) Capacitors Ca and Cb of FIG. 1 are sized such as not to store a significant amount of energy in comparison to the amount of energy drawn by the central power supply during one complete half-cycle of the 240Volt/60Hz power line voltage, while at the same time to store an amount of energy that is several times as large as the amount of energy used by the inverters during one half-cycle of the 30 kHz inverter output voltage.

(g) The power supplied to the fluorescent lamps depends on the timing or phasing of the trigger pulses provided to high-power inverter HPI. In turn, the timing of these trigger pulses depend on the delay associated with the process of charging capacitor C2 to a voltage high enough to cause breakdown of Diac D2. The length of this delay can be adjusted over a wide range by adjusting the time-constant associated with R2/C2.

(h) It is noted that inverter LPI and transformers Tl and T2 may be completely removed, yet the system would still be operable, albeit that the fluorescent lamps would then operate in an instant-start manner. However, the peak power levels then required for lamp starting would be substantially higher, which would result in substantially more costly components.

(i) It is believed that the present invention and its attendant advantages and features will be understood from the preceeding description. However, without departing from the spirit of the invention, changes may be made in its form and in the construction and interrelationships of its component parts, the form herein presented merely representing the presently preferred embodiment.

I claim:

1. The arrangement comprising:

a power supply connectable with an ordinary electric utility power line and conditionally operable to provide a first AC voltage at a first output and a second AC voltage at a second output, said power supply having control means receptive of control information and operative in response thereto to cause said first and/or said second AC voltage to be provided and/or not to be provided;

an assembly of fluorescent lamps, each lamp requiring cathode heating power and current-limited lamp starting and operating voltage, said assembly having: (i) transformer means connected with said first output and operable to provide said cathode heating power, and (ii) ballasting means connected with said second output and operable t provide said current-limited lamp starting and operating voltage; and programming means connected with said control means and operative to provide control information thereto, whereby said first and/or second AC voltage may programmably be provided and/or not provided independent of one another.

2. The arrangement of claim 1 wherein the power supply comprises frequency conversion means and wherein the frequency of one of said AC voltages is substantially higher than that of the voltage on said power line.

3. The arrangement of claim 1 wherein said ballasting means comprises an L-C circuit effectively connected across said second output, and wherein this L-C circuit is resonant at or near the frequency of said second AC voltage.

4. The arrangement of claim 1 wherein said programming means is operative to cause said second AC voltage to begin to be provided only after said first AC voltage has been provided for a brief period of time.

5. The arrangement of claim 4 wherein said brief period of time is on the order of one second.

6. The arrangement of claim 1 wherein said first AC voltage ceases to be provided after said second AC voltage has been provided for some period of time.

7. The arrangement comprising:

a power supply connectable with an ordinary electric utility power line and operable to provide a first AC voltage at a first output and a second AC voltage at a second output, said power supply having control means receptive of control information, said control means being operative in response to said control information to increase and/or decrease the magnitude of said second AC voltage;

an assembly of fluorescent lamps, each lamp requiring cathode heating power and current-limited lamp starting and operating voltage, said assembly having: i) transformer means connected with said first output and operative to provide said cathode heating power, and ii) ballasting means connected with said second output and operative to provide said current-limited lamp starting and operating voltage; and programming means connected with said control means and operative to provide control information thereto, whereby said second AC voltage may be provided or not provided independent of said first AC voltage, thereby permitting said cathode heating power to be provided some time before said lamp starting and operating voltage is provided.

8. The arrangement comprising:

a power supply: (i) being connectable with an ordinary electric utility power line, (ii) being operable to provide a first AC voltage at a first output and a second AC voltage at a second output, and iii) having control means receptive of control information and operative controllably to increase and/or decrease the magnitude of said first AC voltage;

an assembly of fluorescent lamps, each lamp requiring cathode heating power and current-limited lamp starting and operating voltage, said assembly having:(i) transformer means connected with said first output and operative to provide cathode heating power for said lamps, and (ii) ballasting means connected with said second output and operative to provide said current-limited lamp starting and operating voltage; and programming means connected with said control means and operative to provide control information thereto, whereby said first AC voltage may be provided or not provided independent of said second AC voltage, thereby permitting the removal of said lamp cathode heating power some time after said lamp starting and operating voltage has been provided.

9. An arrangement comprising:

a gas discharge lamp having a starting voltage and an operating voltage, the starting voltage being of substantially larger magnitude than the operating voltage;

a current source operative to connect with this lamp and, when so connected, to provide said starting voltage and operating voltage, the starting voltage and operating voltage thereby provided being periodic and having a period; and protection means connected in parallel circuit with the lamp and operative to provide an effective short circuit thereacross in the event hat the lamp were not to start within a brief period ater having been connected with the current source, the brief period having a duration longer than said period, the short circuit remaining in effect until the source is disabled or disconnected.

10. The arrangement of claim 9 wherein said brief period is on the order of 100 milli-seconds.

11. The arrangement of claim 9 wherein the protection means comprises voltage-limiting means operative to prevent the magnitude of the voltage developing across the lamp from substantially exceeding that of said starting voltage.

12. The arrangement of claim 9 wherein said current source is operative to provide an alternating current of frequency substantially higher than that of the voltage on an ordinary electric utility power line.

13. An arrangement comprising:

a gas discharge lamp having a starting voltage and an operating voltage, the starting voltage being of substantially larger magnitude than the operating voltage.

a current source operative to connect with this lamp and, when so connected, to provide said starting voltage and operating voltage, the starting voltage and operating voltage being periodic and having a period; and protection means connected in parallel circuit with the lamp and operative to: (i) prevent the magnitude of the voltage developing across the lamp from substantially exceeding that of said starting voltage, even if the lamp were to be inoperative, and (ii) provide an effective short circuit thereacross, but only in the event that the lamp were not to start within a brief period after having been connected with the current source, the duration of the brief period being longer than that of said period.

14. An arrangement comprising:

a source of AC voltage, the AC voltage having a basic period;

a series combination of an inductor and a capacitor effectively connected across said AC voltage, said series-combination being series-resonant at or near the frequency of said AC voltage;

means operative to permit connection of a gas discharge lamp effectively in parallel with said capacitor, this lamp : (i) having a starting voltage and an operating voltage, the starting voltage being of magnitude substantially larger than that of the operating voltage, and (ii) when functioning and connected with the capacitor, being operative to limit the magnitude of the voltage developing thereacross to a non-destructive level; and protection means effectively connected in parallel with the capacitor and, if the lamp is non-functioning or non-connected, operative to: (i) limit the magnitude of the voltage developing thereacross to a non-destructive level, and (ii) cause a short circuit to be placed thereacross, but only in the event that the voltage developing thereacross were to remain at a magnitude substantially higher than that of said operating voltage for loner than a relatively brief period, the relatively brief period being longer than said basic period.

15. The arrangement of claim 14 wherein said relatively brief period of time is on the order of 100 milliseconds.

16. The arrangement of claim 14 wherein said protection circuit comprises non-linear resistive means operative to limit the magnitude of the voltage developing across the capacitor.

17. An arrangement comprising:

rectifier means connected with an ordinary electric utility power line and operative to provide a DC voltage at a DC output;

inverter connected with said DC output and operable at will in response to a control signal provided at a control input to provide or not to provide an AC voltage at an AC output; and fluorescent lighting means connected with said AC output;

whereby the lighting means can be turned ON and OFF in response to such a control signal applied to the control input, even through the DC voltage is being provided on a continuous bases.

18. The arrangement of claim 17 wherein the inverter is of the self-oscillating type.

19. The arrangement of claim 17 wherein said power line provides a 60 Hz voltage and wherein said DC voltage is non-filtered and effectively comprised of 120 Hz unidirectional voltage pulses.

* * * * *